US008919602B2

(12) United States Patent
Nolan et al.

(10) Patent No.: US 8,919,602 B2
(45) Date of Patent: Dec. 30, 2014

(54) SAFETY SHIELD FOR FUEL GAS TANK

(71) Applicant: Tank Right Systems LLC, Dewitt, NY (US)

(72) Inventors: Shawn Nolan, Dewitt, NY (US); Michael Fey, Kirkville, NY (US); Richard R. Coon, Syracuse, NY (US); John J. Fitzsimmons, Clay, NY (US)

(73) Assignee: Tank Right Systems LLC, Dewitt, NY (US)

( * ) Notice: Subject to any disclaimer, the term of this patent is extended or adjusted under 35 U.S.C. 154(b) by 34 days.

(21) Appl. No.: 13/891,307

(22) Filed: May 10, 2013

(65) Prior Publication Data

US 2014/0332544 A1 Nov. 13, 2014

Related U.S. Application Data

(60) Provisional application No. 61/645,669, filed on May 11, 2012.

(51) Int. Cl.

| | |
|---|---|
| ***B65D 55/00*** | (2006.01) |
| ***F17C 13/06*** | (2006.01) |
| ***B65D 43/02*** | (2006.01) |
| *B65D 51/18* | (2006.01) |

(52) U.S. Cl.

CPC ..... *F17C 13/06* (2013.01); *B65D 43/0222* (2013.01)

USPC ..... 220/731; 220/602; 220/724

(58) Field of Classification Search

CPC ... F17C 13/06; F17C 2205/0308; F16K 35/10

USPC ..... 220/731, 724, 725, 602

See application file for complete search history.

(56) References Cited

U.S. PATENT DOCUMENTS

| | | | | | |
|---|---|---|---|---|---|
| 2,085,277 | A | * | 6/1937 | Smith | 220/602 |
| 2,996,213 | A | * | 8/1961 | Mitchell et al. | 220/582 |
| 3,154,211 | A | | 10/1964 | Bobowski | |
| 3,285,418 | A | * | 11/1966 | Miller | 210/140 |
| 3,848,768 | A | | 11/1974 | Griffin | |
| 4,103,806 | A | | 8/1978 | White | |
| 4,478,345 | A | | 10/1984 | Edinger | |
| 4,600,033 | A | * | 7/1986 | Baron | 137/382 |
| 4,899,781 | A | * | 2/1990 | Monroe | 137/382 |
| 4,905,855 | A | | 3/1990 | Troiano et al. | |
| 5,058,758 | A | * | 10/1991 | Suddeth | 220/724 |
| 5,678,864 | A | | 10/1997 | Brown | |
| 5,845,809 | A | | 12/1998 | Garrett et al. | |
| 6,003,540 | A | | 12/1999 | Bruni et al. | |
| 6,209,749 | B1 | | 4/2001 | Guess | |
| 6,247,491 | B1 | * | 6/2001 | Petryna | 137/382 |

(Continued)

*Primary Examiner* — Mickey Yu
*Assistant Examiner* — Niki Eloshway
(74) *Attorney, Agent, or Firm* — Bernhard P. Molldrem, Jr.

(57) ABSTRACT

A protective shield fits onto a fuel cylinder that is mounted on a propane-powered or LNG-powered vehicle, with a cylindrical flange on the tank surrounds a tank valve. The protective shield is formed of a cylindrical wall of a rubber-like material that fits snugly onto the cylindrical flange of the fuel tank, and has a window affixed into its upper end of the cylindrical wall. The window can be a disk of transparent plexiglass. There are openings in the cylindrical wall to access the tank valve. The shield provides visibility of the tank valve but prevents any spray of the fuel that may escape from the tank valve from reaching the worker's face or other exposed skin.

9 Claims, 10 Drawing Sheets

(56) References Cited

U.S. PATENT DOCUMENTS 6,536,462 B1 * 3/2003 Laugen ..... 137/296
7,178,546 B2 * 2/2007 Gremillion, III ..... 137/15.01
8,720,738 B1 * 5/2014 Ryman ..... 220/724
2005/0092761 A1 * 5/2005 Marganski et al. ..... 220/724

* cited by examiner

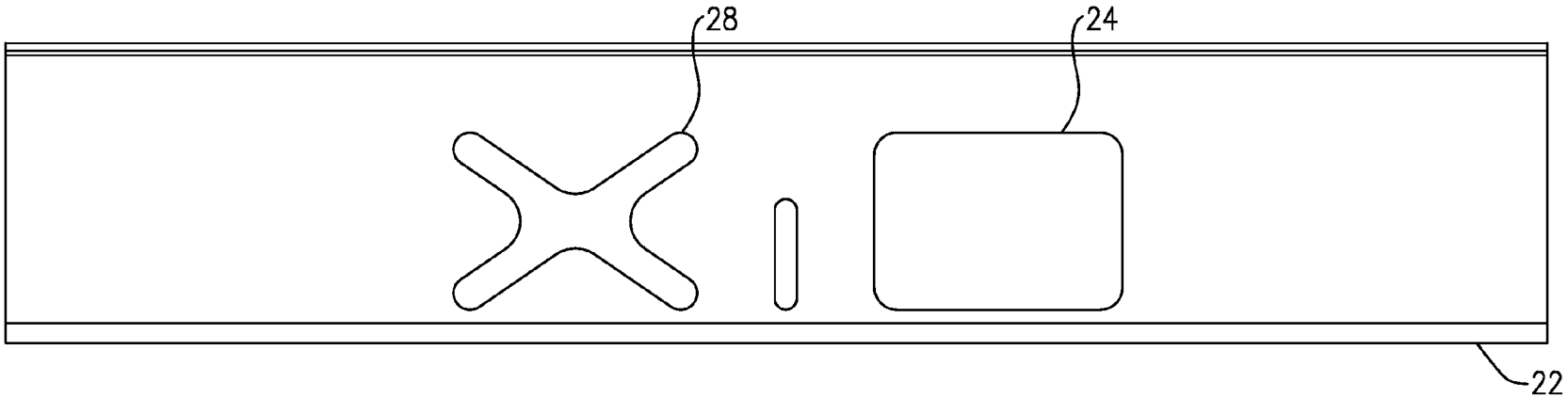
FIG.9
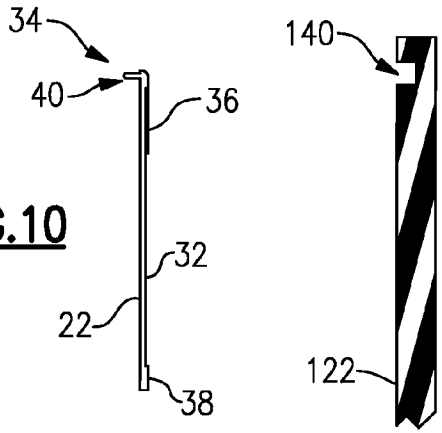
FIG.13
FIG.10

SAFETY SHIELD FOR FUEL GAS TANK

Applicant claims priority under 35 U.S.C. §119(e) of provisional patent application Ser. No. 61/645,669, filed May 11, 2013, the disclosure of which is incorporated by reference.

BACKGROUND OF THE INVENTION

This invention concerns protective shields for industrial equipment, and in particular is concerned with a safety shield or cover that fits over the valves and fittings of a propane tank or other fuel gas tank as employed with powered industrial equipment, such as fork lifts, tractors, or the like.

One continuing danger in respect to gas powered vehicles and devices is that the compressed gas can escape rapidly from the fittings during installation onto the fork lift or other vehicle, and can cause freezing of tissue to the worker if the spray contacts his or her face or exposed skin. Compressed gas stored in portable steel tanks is widely used in factory and warehouse environments nationwide, for powering indoor vehicles and other equipment. The danger from the escaping gas is a concern for worker safety Typically workers are required to wear goggles, safety glasses or face mask, as well as gloves, when installing or replacing a fuel tank, but these items do not provide complete protection for the worker. Under the current laws and guidelines, employers are required to provide a hazard-free environment for their employees. According to the Occupational Safety and Health Administration (OSHA), as stated in their OSHA Compliance Manual-, Personal Protection Equipment: the use of personal protection equipment or PPE, e.g., face shields, is considered a "last resort" or temporary type of protection. PPE itself can cause stress and create work hazards of its own, such as heat stress, impaired vision, and limits on mobility. For normal and ongoing operations, the first choice will always be given to elimination of the hazard in the environment, rather than relying on PPE. This doctrine is referred to as "implementing engineering controls".

To date, no engineering controls have been developed or proposed to address the problem of liquid fuel gas and compressed gas escaping and spraying onto workers when replacing an empty tank with a full one. This need has been addressed only using PPE, such as goggles or safety glasses and gloves or gauntlets. It would by far be preferable to stop any spray of this material before reaching the worker, and not to rely on the personal protection equipment.

There is an unfulfilled need for a simple, comfortable, inexpensive, easy-to-install protective device for the tank itself, rather than relying on PPE fitted onto the worker. This would require a guard or shield that permits visual observation of the tank valve and fittings when installing or replacing the tank, and when opening or closing the tank valve, and which does not have to be worn by the worker. The solution to this problem would also require a shield or guard that can be easily slipped onto the tank over the tank valve, and can be easily removed from the tank so that it can be sent off for refilling or maintenance. The guard or shield should also be light weight and durable, without sharp edges that could cause cuts or other injury to the worker.

SUMMARY OF THE INVENTION

This invention concerns a protective shield that fits onto the flange at one end of a tank or cylinder of compressed propane or butane as used in an industrial setting, i.e., for a forklift or similar warehouse vehicle. A cylindrical rubber wall or sleeve, or alternatively an extruded sleeve formed into a cylinder, has an inside diameter that fits snugly onto the cylindrical tank flange, and has access openings to allow the worker to attach the gas fittings and to open and close the tank valve. A circular clear window is placed into an upper end of the generally cylindrical wall, and allows clear visibility of the fittings and valve. At the same time, the window blocks any gas or liquid that escapes from the tank valve from exiting out the upper end of the shield, thereby protecting the worker from an accidental spray of the liquid propane or butane (which could cause freezing of tissues). This is intended to satisfy OSHA requirements for personal safety by blocking or eliminating the propane spray hazard before a face shield or protective eyewear and facewear is needed.

Preferably, the cutouts or openings in the cylindrical shield wall include a generally rectangular wall aligned with the tank valve fitting, to allow the fuel hose to pass through, while the opening for the worker to reach through to turn the valve can be formed of crossed slots, i.e., shaped like the letter "X". This minimizes the open area of the opening when the worker is operating the valve, which will limit the possibility of escaped fuel gas exiting through the reach-in opening. The X-shaped opening can also serve to retain the glove or gauntlet between uses, so the worker has easy access to the safety gloves.

In a preferred embodiment, the cylindrical wall of the shield is formed of an extrusion of a rubber or synthetic elastomeric resin, with ends butt welded to form a ring. A reinforcing ring is formed on an outer surface of the wall at its lower end, and at the upper end there may be a band of a distinctively colored material, e.g., bright orange or bright green, to increase the visibility of the shield. At the upper end of the cylindrical wall, at the inside surface, an inwardly directed flange locates the clear plastic disk or other window that held in place here. Other possible constructions of the shield wall are also possible.

The material of the wall may have a weakly conductive filler so that static electrical charge will dissipate, and not pose a threat of static discharge.

In a preferred implementation, the rubber cylindrical wall is about seven inches high, with a twelve-inch inside diameter, and with a clear plexiglass disk serving as the window. In some possible embodiments, the window may be partly transparent and partly opaque or translucent.

BRIEF DESCRIPTION OF THE DRAWING

FIG. 9 is a layout diagram of the rubber wall portion that forms the cylindrical wall of the protective shield, showing the valve access openings and a position pin opening.

FIG. 10 is a side cross section thereof showing a recess for fitting the clear disk window portion thereof.

FIG. 13 is cross section of the cylindrical wall portion according to an alternative embodiment.

DETAILED DESCRIPTION

Figure 1:
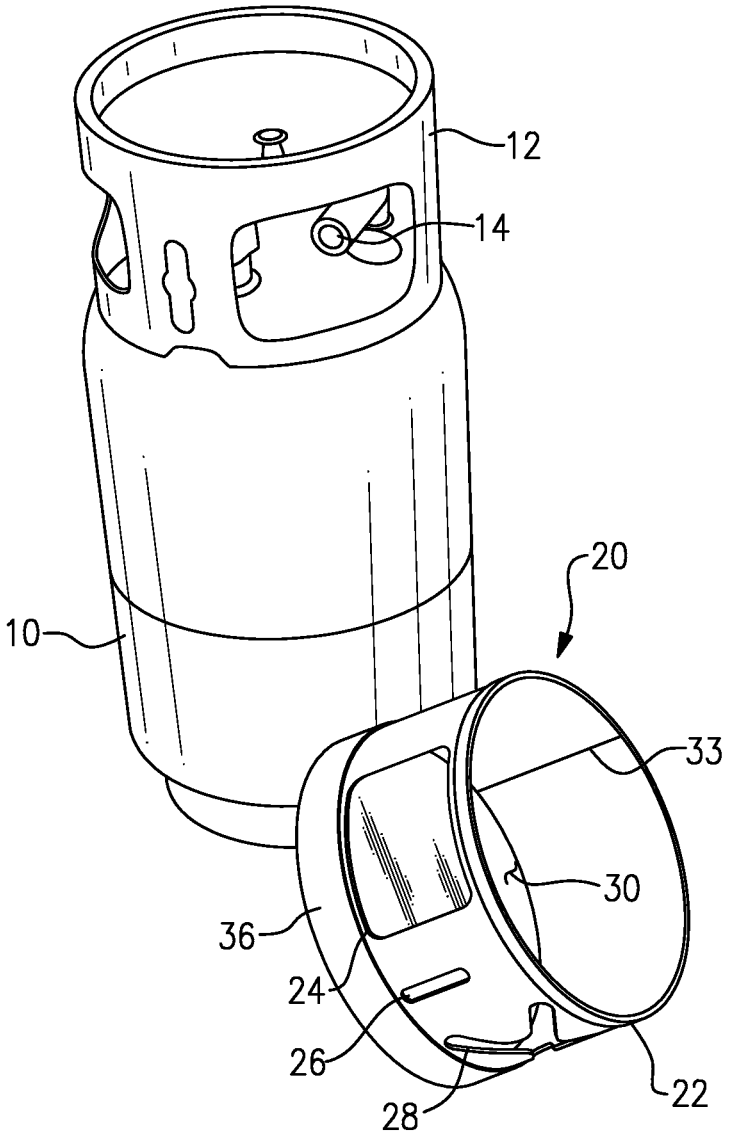
FIG. 1 and FIG. 2 are perspective views of a typical propane fuel tank and a protective shield according to an embodiment of this invention, with FIG. 2 showing a worker installing the protective shield onto the flange of the tank.
Figure 2:
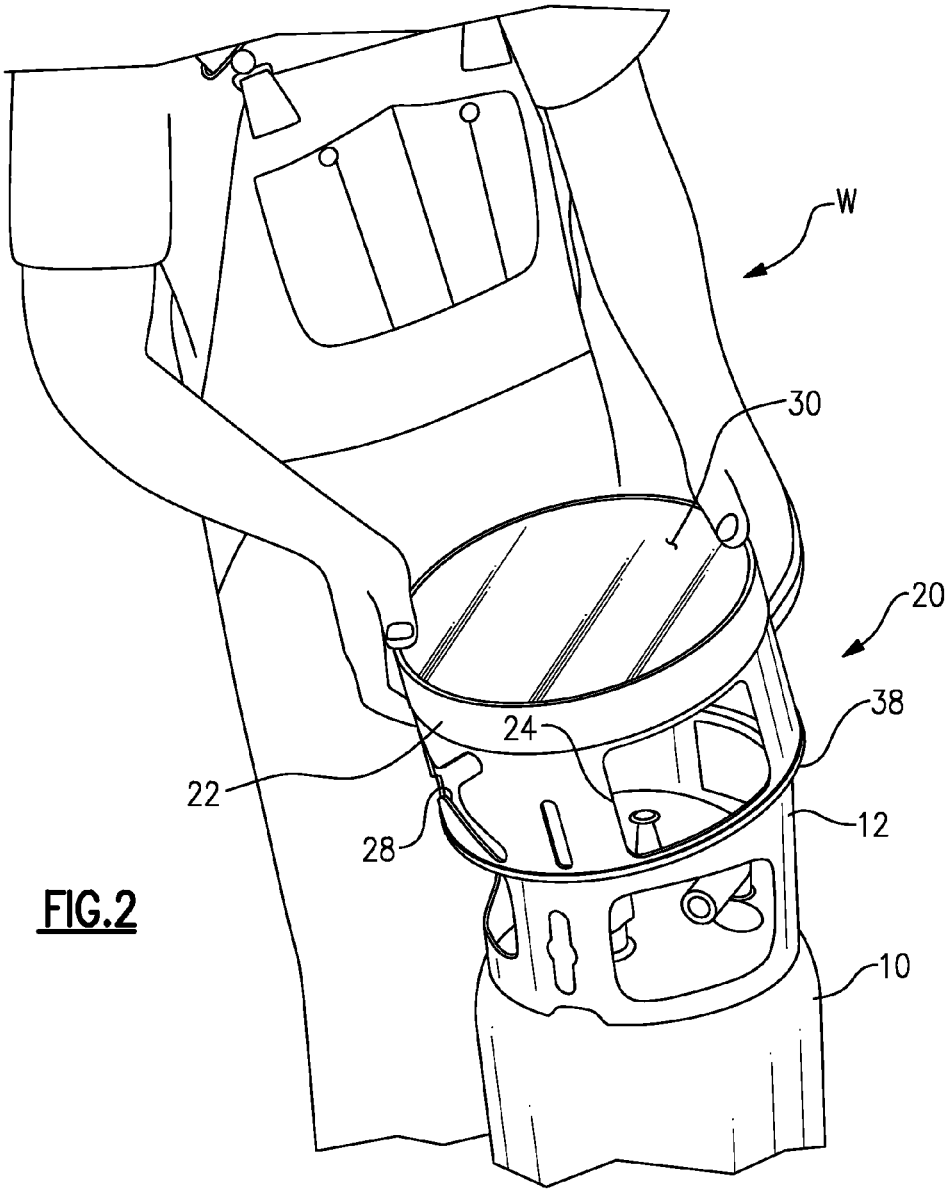

FIG. 1 shows a typical propane tank 10 as used as a fuel source for a warehouse vehicle. The tank 10 holds a quantity of compressed and liquified fuel such as propane. The tank 10 is made of steel and has a generally cylindrical steel flange 12 at its upper end, approximately twelve inches in diameter, with various fittings and connections within the flange 12 including a tank valve 14 that connects to the fuel hose for the vehicle. A protective shield 20 according to an embodiment of this invention is shown here next to the tank 10, and generally takes the form of a cylindrical cap or cover to fit onto the cylinder flange 12. The protective shield has a sturdy, flexible rubber wall 22 in the form of a cylinder having an inner diameter of approximately twelve inches and a height of about seven inches, with a first valve access opening 24, a key slot 26, and a second valve access opening 28 cut into it. A transparent plastic window 30 is mounted at the upper end. The window here is in the form of a clear plexiglass disk having a diameter of about twelve-and-one-quarter inches and a thickness of about ⅜ inch to ⅝ inch, preferably one-quarter inch. FIG. 2 shows a worker W mounting the shield 20 onto the flange 12 of the tank 10, with the openings 24, 26, 28 aligning with corresponding openings on the tank flange 12.

Figure 3:
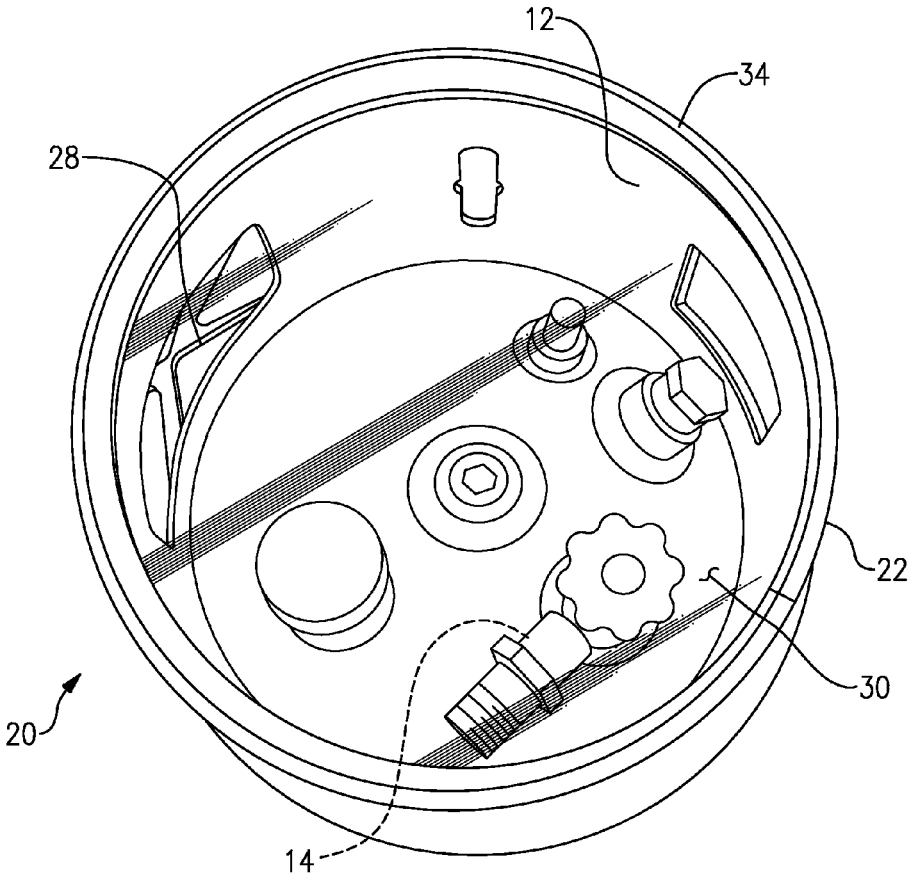
FIG. 3 is a top plan view of the protective shield installed onto the flange of the tank.
Figure 4:
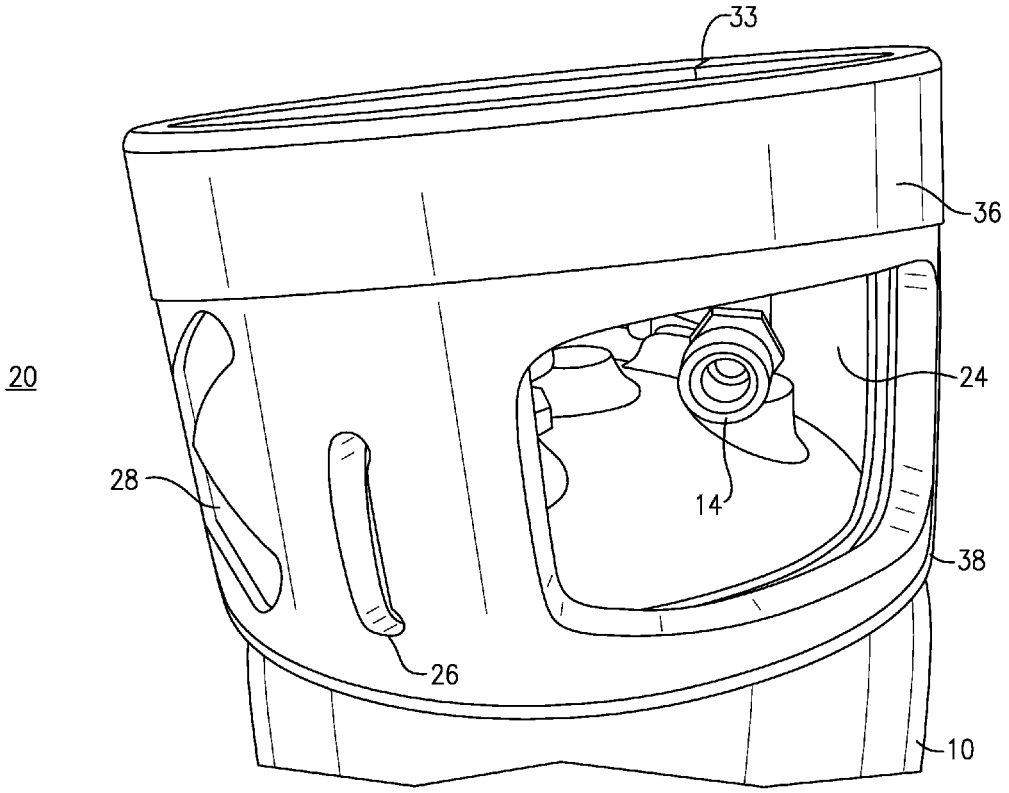
FIG. 4 is a side view of the protective shield of this embodiment installed on a tank.

As shown in FIG. 3, once the protective shield 20 is installed onto the flange 12, the window 30 covers the entire extent of the upper end of the flange 12, but the tank valve 14 is visible through the window. FIG. 4 shows the fitting of the tank valve 14 being accessible for attaching the fuel hose through the valve access opening 24 in the shield wall 22. In alternative embodiments, some portions of the disk could be opaque.

Figure 5:
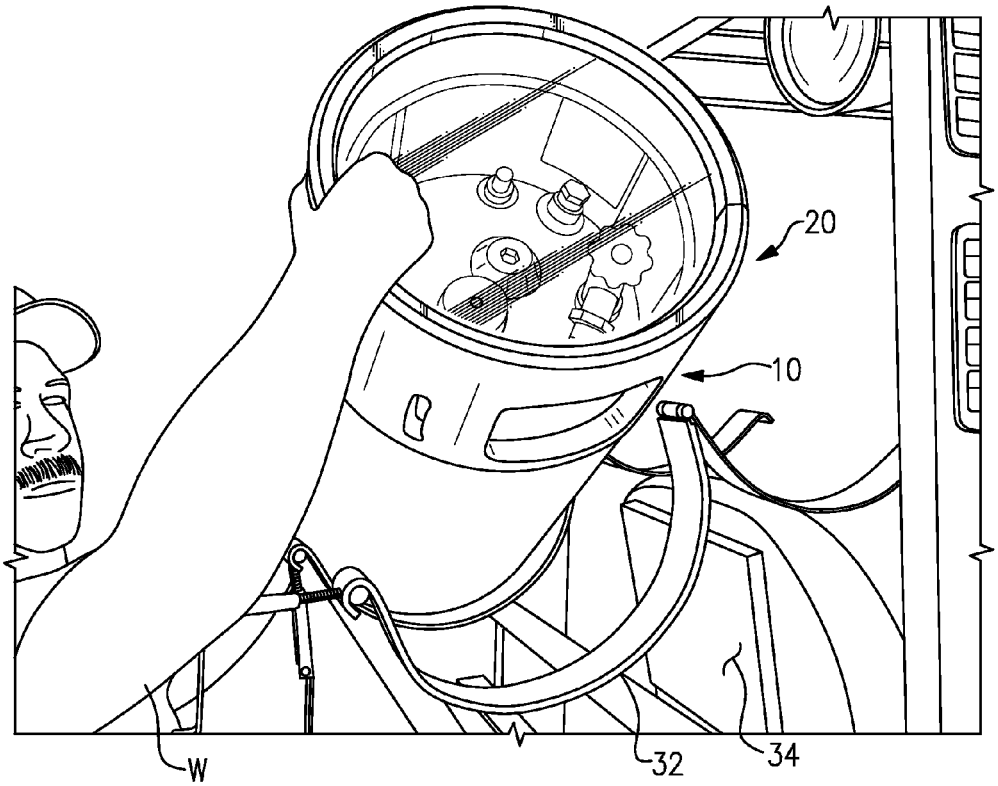
FIG. 5 is a perspective view showing the tank with protective shield being placed onto the tank cradle of a vehicle.
Figure 6:
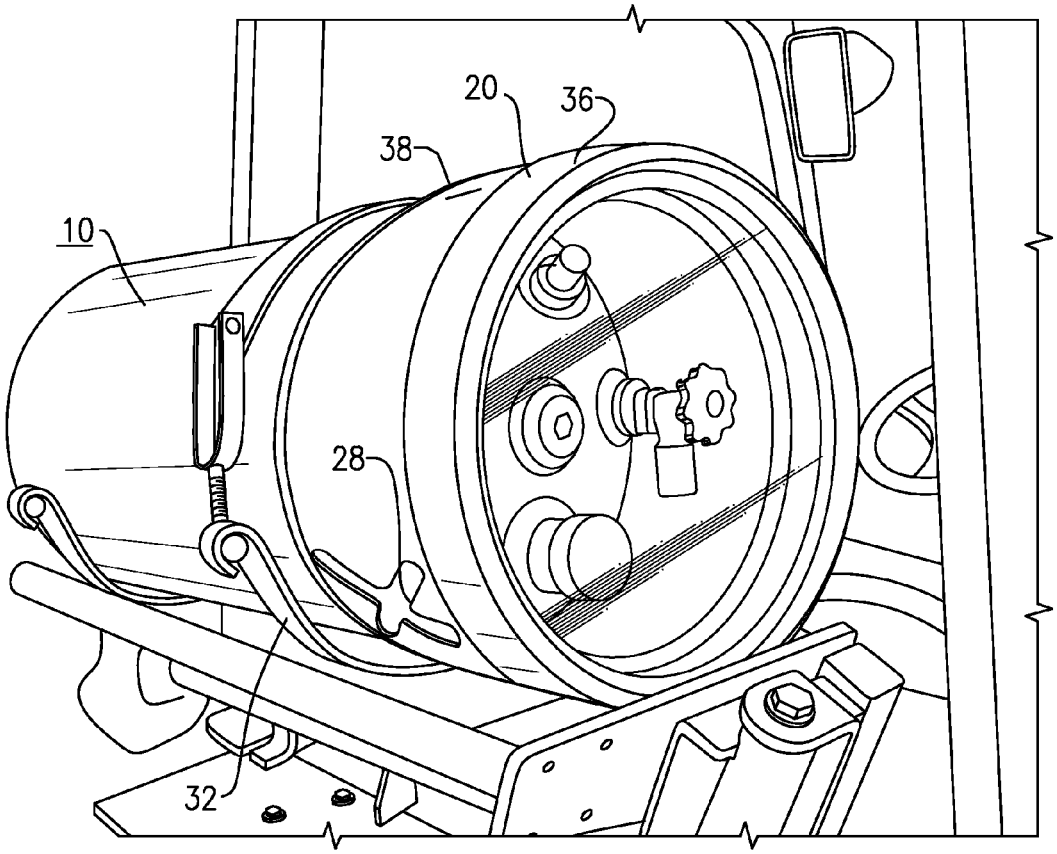
FIG. 6 is a perspective view showing the tank with protective shield as having been installed on the tank cradle of the vehicle.
Figure 7:
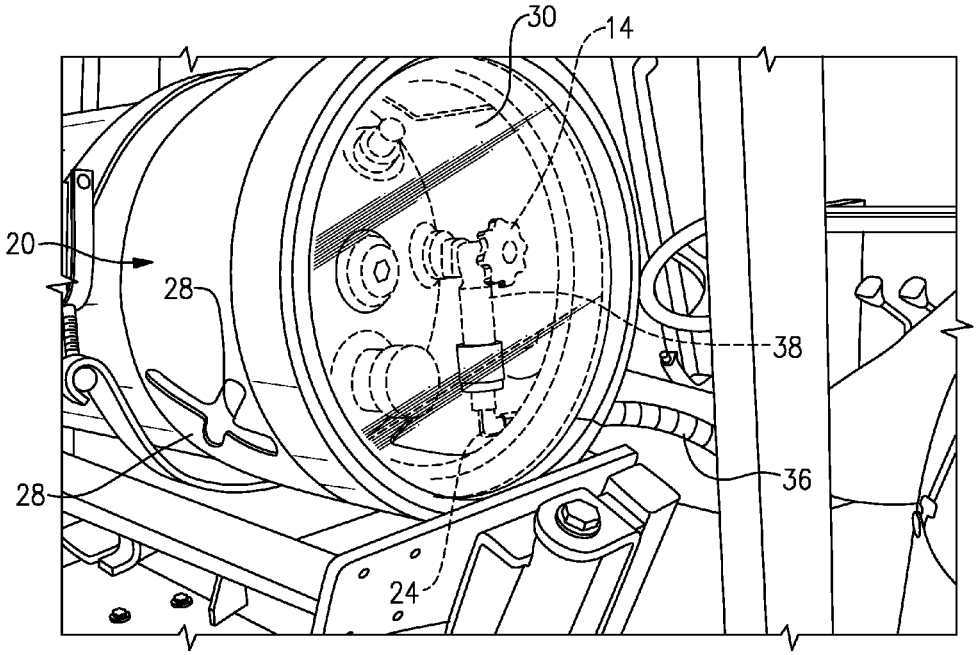
FIG. 7 is a perspective view thereof showing a worker attaching a vehicle fuel line to the tank valve.
Figure 8:
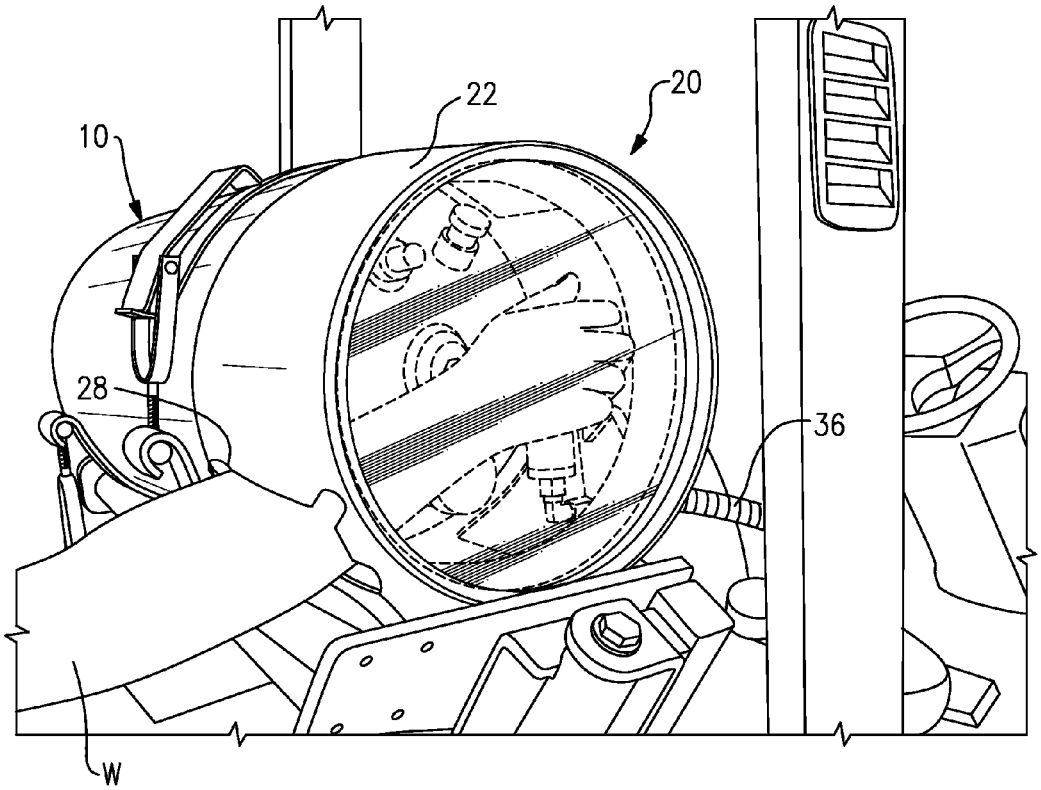
FIG. 8 is a perspective view thereof showing the worker opening the tank valve

As shown in FIG. 5, the worker W is installing a full fuel tank 10, with the shield 20 in place on the flange 12, onto a forklift of similar vehicle 34 by laying the tank 10 horizontally on a tank cradle 32 of the vehicle 34, with the flange 12, valve 14 and shield 20 at the right hand side of the vehicle, so that the tank 10 is positioned as shown in FIG. 6. The worker W then attaches a fuel hose 36, feeding it through the access opening 24 and attaching it to the tank valve 14 by rotating or screwing on a threaded fitting 38. For purposes of illustration, the worker W's hands are shown, but in practice the worker W would wear protective gloves for this operation. Then, as shown in FIG. 8, the worker W can reach in through the X-shaped valve access opening 28 with his gloved hand to rotate the tank valve 14 to open it. During this entire operation, the window 30 of the protective shield stands between the valve 14 and the worker, except for his gloved hands. The worker W sees the valve 14 clearly during installation of the fuel hose fitting and when the worker opens the valve, but the window 30 will protect the worker from any spray of the compressed liquid fuel that might escape during this operation.

The protective shield 20 remains in place during operation of the vehicle 34, and when the empty tank 10 is removed, the shield can be slipped off and placed on the tank flange 12 of a fresh fuel tank.

FIGS. 9 and 10 show some of the structure of the body of the cylindrical rubber wall 22, here a blank 32 that is laid flat, and which can be wrapped into a cylindrical shape and the ends fastened or adhered together. The ends are preferably joined as a butt weld 33 (see also FIGS. 1 and 3). The rubber-like material of blank 32 may have a filler of carbon or another weakly conductive material so as to dissipate any static charge that may be imposed on the shield from handling, to minimize risk from static discharge. The blank 32 has a height of about seven inches and a length of about three feet, four inches. The valve access openings 24 and 28 are cut out to have, in effect, a height dimension of three inches and a length dimension of six inches, and the key slot opening 26 has a height dimension of two-and-three-quarters inches with a length dimension of one-half inch. As shown in cross-section of FIG. 10, near its upper edge, the cylindrical wall 22 has an inwardly directed solid lip or flange 34 that is situated at an upper edge of the wall, i.e., the top edge of the blank 32. This lip 34 defines surface or location 40 that the disk 30 seats against. The outer side of the upper edge of the cylindrical wall 22 is curved or chamferred, and a band 36 of a highly visible distinctive color, e.g., yellow or orange, is affixed here. This color band 36 makes the presence of the shield 20 more visible under warehouse lighting conditions. At a lower edge of the cylindrical wall 22, a reinforcing ring 38 is present, preferably formed as a lower part of the blank 32.

Figure 12:
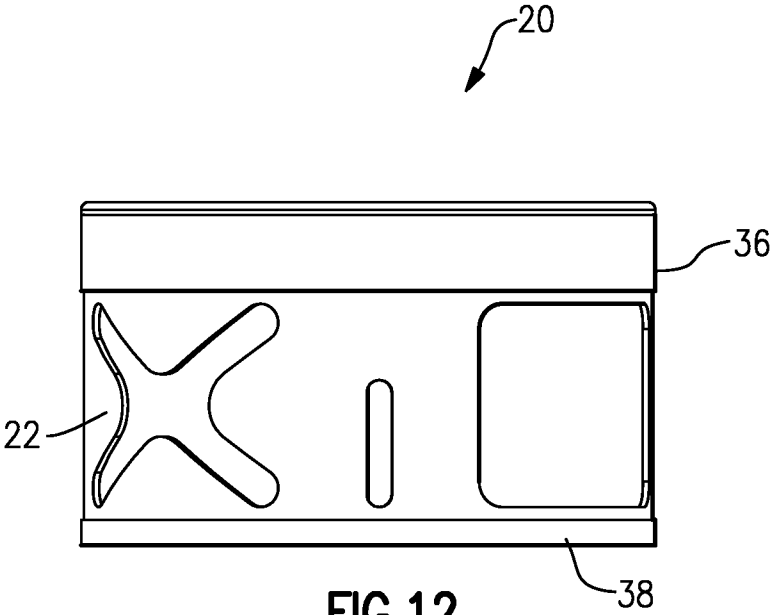
FIG. 12 is a side elevation of the cylindrical wall portion showing the general height and diameter thereof.
Figure 11:
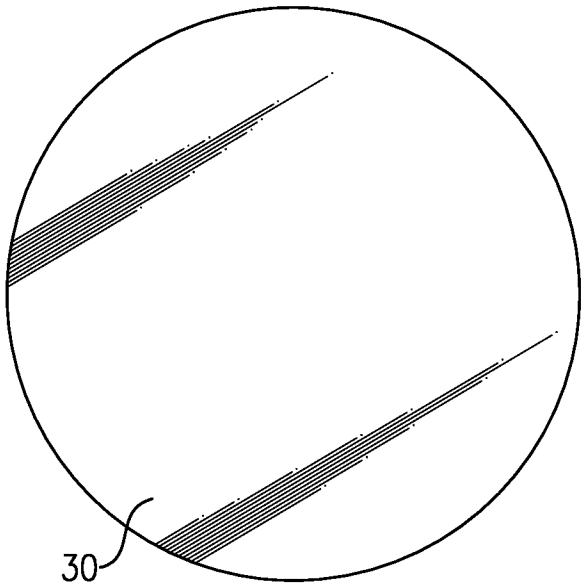
FIG. 11 is a plan view of the clear disk window thereof.

A plan view of the window disk 30 is presented in FIG. 11, and a side elevation of the shield or guard 20 is presented in FIG. 12.

In an alternative construction, as presented in FIG. 13, the rubber wall 122 can be of about half-inch to five-eighths inch thick rubber or rubber foam material, with a continuous elongated cutout 140 of about one-quarter inch depth for capturing the edge of the window disk 30.

The clear plastic window disk 30 (FIG. 11) of this embodiment has a diameter of about twelve-and-one-quarter inches, with a thickness of one-quarter inch. The disk can be entirely clear, or may have some portions that are translucent or opaque, and may include reinforcement, as needed.

FIG. 12 shows the shield or guard in an elevation profile, and the shield wall 22 has a height of seven inches and a diameter of about thirteen inches. The shield should be dimensioned to fit the end flange of a given type of tank.

Many alternative arrangements of the tank shield of this invention can be constructed without departure from the main principles of the invention. The cutouts or openings 24 and 28 may be reversed from what is shown here, depending upon the orientation of the associated tank valve. The tank guard should be constructed to be light-weight and durable, and the materials from which it is constructed may thus may be selected from many possible materials In alternative embodiment, the cylindrical wall may ends joined by blind byrd insert fasteners, and other alternative fastening systems could be employed. In other possible embodiments, the wall 22 may be formed of a generally cylindrical extrusion of a suitable flexible durable material. Also there are other ways in which the window 30 can be attached or affixed into the upper end of the cylindrical wall 22, and in some possible embodiments the window 30 need not be of a circular shape. As an alternative to the more-or less solid wall 22 with only the three access opening 24, 26, 28, the protective shield may be made with upper and lower rings joined by a series of axial ribs, leaving most of the cylinder flange 12 uncovered except the protective window. In that case, the ribs may be of a more rigid material, at least in part.

While the device of this invention has been explained and illustrated with respect to a preferred embodiment, it should be understood that many other possible embodiments would be apparent from this disclosure to persons skilled in the art, without departure from the scope and main principles of the invention.

We claim:

1. A protective shield for use on a fuel gas tank for a vehicle, wherein the tank is of a type having at one end thereof a generally cylindrical flange affixed thereon and having a side wall of a predetermined outer diameter and surrounding a tank valve, the flange having at least one valve access opening in the side wall thereof; and the protective shield comprising a generally cylindrical wall of a yieldable material with a predetermined inside diameter dimensioned and configured to fit snugly onto said cylindrical flange of the fuel tank and being open at a lower end thereof, and a window affixed non-removably into an upper end of the cylindrical wall, the window being formed at least in part of a rigid transparent material to permit viewing of the tank valve but configured to block any spray exiting the tank valve from passing out the upper end of the protective shield, the generally cylindrical wall of the protective shield having at least a first valve access opening therein adapted to align with the at least one valve access opening of the generally cylindrical flange side wall, such that during a fuel hose fitting operation, the tank valve is visible to an operator through the window, but the window will protect the operator from any spray of liquid fuel which may escape during the fitting operation.

2. The protective shield of claim 1 in which the window is formed of a disk of a transparent plastic material.

3. The protective shield of claim 1 in which the generally cylindrical wall is formed of a durable rubber-like material, and with a plurality of openings therein positioned to align with a respective plurality of valve access openings of the tank flange.

4. The protective shield of claim 3 wherein at least one of said openings in said generally cylindrical wall consists of a pair of crossed slits defining an X-shaped cutout, and configured to permit the operator to reach through with the operator's hand to manipulate said tank valve.

5. The protective shield of claim 3 wherein said generally cylindrical wall includes at its upper end an inwardly-directed flange defining an annular retaining location onto which said window is seated within the upper end of said cylindrical wall.

6. The protective shield of claim 3 wherein said generally cylindrical wall has a reinforcing ring on an outer surface thereof at its lower end.

7. The protective shield of claim 1 wherein the yieldable material of said generally cylindrical wall includes a rubber-like material containing sufficient conductive filler material to dissipate any static charge that may accumulate on the generally cylindrical wall.

8. The protective shield of claim 1 including a band of a distinctively colored material surrounding an outer surface of the generally cylindrical wall at its upper end.

9. The protective shield of claim 1 wherein said wall has an annular cutout integrally formed on its interior surface at its upper end, and said window is formed of a disk of a transparent plastic material having an edge thereof non-removably retained in said annular cutout.

* * * * *